US009541348B2

(12) United States Patent
Rogers et al.

(10) Patent No.: US 9,541,348 B2
(45) Date of Patent: Jan. 10, 2017

(54) FIREARM HOLSTER WITH AUTOMATIC OPTICAL SIGHT PROTECTOR

(71) Applicant: Rogers Holster Co., LLC, Jacksonville, FL (US)

(72) Inventors: William H. Rogers, St. Augustine, FL (US); Gregory D. Gossett, Jacksonville, FL (US)

(73) Assignee: Rogers Holster Co., LLC, Jacksonville, FL (US)

( * ) Notice: Subject to any disclaimer, the term of this patent is extended or adjusted under 35 U.S.C. 154(b) by 665 days.

(21) Appl. No.: 13/744,163

(22) Filed: Jan. 17, 2013

(65) Prior Publication Data

US 2013/0181020 A1 Jul. 18, 2013

Related U.S. Application Data

(60) Provisional application No. 61/587,515, filed on Jan. 17, 2012.

(51) Int. Cl.
*F41C 33/02* (2006.01)
*F41C 33/00* (2006.01)

(52) U.S. Cl.
CPC ..... *F41C 33/02* (2013.01); *F41C 33/0209* (2013.01); *F41C 33/0227* (2013.01); *F41C 33/0236* (2013.01); *F41C 33/0263* (2013.01)

(58) Field of Classification Search
CPC ..... F41C 33/0227; F41C 33/0236; F41C 33/0254; F41C 33/0263; F41C 33/0209
USPC ..... 224/238, 243, 912, 193, 196, 198
See application file for complete search history.

(56) References Cited

U.S. PATENT DOCUMENTS

| | | | | |
|---|---|---|---|---|
| 3,208,146 | A * | 9/1965 | Nelson | F41A 35/02 359/511 |
| 3,746,423 | A * | 7/1973 | Mills | F41G 1/383 359/511 |
| 4,394,797 | A * | 7/1983 | Schuster | F41G 1/04 42/143 |
| 4,858,361 | A * | 8/1989 | White | F41A 35/02 150/154 |
| 4,912,867 | A * | 4/1990 | Dukes, Jr. | 42/70.11 |
| 6,371,341 | B1 * | 4/2002 | Clifton, Jr. | 224/243 |
| 7,461,765 | B2 * | 12/2008 | French et al. | 224/243 |
| 7,484,856 | B1 * | 2/2009 | Newhall | F41G 1/04 359/511 |

(Continued)

*Primary Examiner* — Justin Larson
*Assistant Examiner* — Lester L Vanterpool
(74) *Attorney, Agent, or Firm* — Kane Kessler, P.C.; Paul E. Szabo

(57) ABSTRACT

Holster carrying a firearm with an optical sight mounted thereon, holster having an open top, inner and outer sidewalls with parallel extension portions, a top wall portion affixed to the extension. A protector includes a U-shaped body with an upper wall, spaced depending side walls, a rear wall and a unitary forward spring tab. The side walls are respectively pivotally connected to the extension portions and movable between closed and open positions. When closed, all the protector walls, the extension portions and the top wall portion substantially enclose a rear part of the sight, including the lens thereof, to inhibit debris from entering. The polymeric tab engages the top wall portion and biases the protector closed which is overcome automatically by forcible withdrawal of the firearm.

6 Claims, 11 Drawing Sheets

(56) References Cited

U.S. PATENT DOCUMENTS

| | | | | |
|---|---|---|---|---|
| 8,024,885 | B1 * | 9/2011 | Newhall | F41G 1/04 359/511 |
| RE44,428 | E * | 8/2013 | Spielberger | F41C 33/0263 224/238 |
| 9,134,093 | B2 * | 9/2015 | Yeates | F41C 33/0272 |
| 2002/0011504 | A1 * | 1/2002 | Cerato | F41A 23/18 224/243 |
| 2005/0035163 | A1 * | 2/2005 | French | F41C 33/0227 224/243 |
| 2007/0175935 | A1 * | 8/2007 | Clifton, Jr. | 224/243 |
| 2007/0181619 | A1 * | 8/2007 | Seyfert | F41C 33/0227 224/196 |
| 2009/0014484 | A1 * | 1/2009 | Spielberger | F41C 33/0263 224/196 |
| 2009/0114693 | A1 * | 5/2009 | Rassias | 224/663 |
| 2010/0083554 | A1 * | 4/2010 | Elpedes | F41G 1/14 42/123 |
| 2011/0101063 | A1 * | 5/2011 | Zusman | F41C 33/0227 224/682 |

* cited by examiner

FIREARM HOLSTER WITH AUTOMATIC OPTICAL SIGHT PROTECTOR

CROSS-REFERENCE TO RELATED APPLICATION

This application claims the benefit of U.S. Provisional Patent Application No. 61/587,515, filed Jan. 17, 2012, and entitled "Firearm Holster With Automatic Optical Sight Protector", which is incorporated herein by reference.

BACKGROUND OF THE INVENTION

The present invention relates to firearm holsters, and more particularly, to handgun holster assemblies, including a protector to cover and protect an optical sight mounted on the firearm, and particularly a protector that automatically opens when the firearm is withdrawn from the holster.

Optical, single point sight devices, such as Aimpoint® sights (available from Aimpoint AB of Jägershillgatan, Sweden), have been available for firearm shooting since the early 1990s. Also known as red dot sights, a single point sight may comprise a frame, an optic, and a light source. The single point sight is attached to a firearm (e.g., pistol, revolver, rifle, and the like) via the frame. The frame is configured to place the optic and the target in the same optical plane, enabling a user to see the target through the optic. The single point sight may be installed near the rear of a handgun slide.

The advantages of single point sights over the conventional iron sights are well noted, however, the size and reliability of the single point sight has limited its use among the military and the police until recently. Companies such as Leupold & Stevens, Inc. of Beaverton, Oreg. and Trijicon, Inc. of Wixom, Mich. have developed very small sights with proven reliability and long battery life, The end result is that gun companies, as well as custom gun makers, are incorporating a small single point sight machined into the slide of a handgun so as to co-witness or align with the conventional front iron sight. Such companies are also machining mounts for such sights into the slides of handguns enabling the consumer to mount his own choice of aftermarket single point sight. Companies such as Fabrique Nationale d'Herstal, S.A. of Herstal, Belgium (FN) have produced a tactical .45 with such a single point sight device. Another custom manufacturer, Bowie Tactical Concepts, LLC of West Union, Ohio, specializes in machining the slides of popular handguns in order to install such single point sight devices.

Holster companies are rapidly re-designing existing holsters to accommodate the raised portion of a firearm caused by the installation of these sights. Holster designs covered by U.S. Pat. Nos. 5,501,381 (the '381 patent) and 7,694,860 can be readily modified and designed such that the holster will accommodate a handgun or other firearm with an attached single point sight. The problem with simply altering the present designs of the holster is that the necessary shape of the top of the holster, where the firearm is inserted and drawn from, creates a funnel that directs dirt, dust, lint, fluids, and other types of debris onto the optic of the single point sight. This collection of debris upon the face of the optic reduces if not eliminates its usefulness. The securing straps on typical holsters, as well as the rotating locking devices of the '381 patent, can shield the optic to some extent, but such devices do not have the ability to seal the single point sight from debris over any extended period or when exposed to various environments. These problems of the industry have continued and are not readily solved. The invention described herein, however does so in a unique and effective manner.

One attempt at providing a cover for an optical sight on the slide of a handgun has been suggested in U.S. Pat. No. 6,327,806, in which the cover is attached by a lanyard to the holster such that when the user removes the handgun from the holster, the cover is pulled off and removed from the sight, making the handgun ready for aiming and firing. Such a solution seems to be undesirable and has not found wide acceptance in the industry.

Several design patents on various covers for various optical sights may be attachable and removable by the user prior to or after withdrawal of a firearm from the holster by the user. When used, such covers require a two-step process to ready the weapon for firing. First, the user must draw the weapon. Second, the user must remove the cover. This two-step process undesirably reduces weapon readiness and increases draw times compared to holstered weapons without a cover.

SUMMARY OF THE INVENTION

In view of the foregoing it is an object of the present invention to provide an improved holster with an optical sight protector.

In particular, it is an object of this invention to provide such an improved holster in which the optical sight protector is unitary with and an integral part of the holster.

A further object is to provide such an improved holster in which the optical sight protector automatically uncovers the optical sight when and as the user withdraws the firearm from the holster.

These and other objects, aspects and advantages of the present invention will be better appreciated in view of the drawings and following detailed description of a preferred embodiment.

BRIEF DESCRIPTION OF THE DRAWINGS

FIG. 1 is a side elevational view of a firearm holster with the protector shown in a fully closed position according to the present invention with a handgun shown therein, and the holster being without a back plate or a paddle or belt loop or the like;

DETAILED DESCRIPTION OF A PREFERRED EMBODIMENT

Figure 1:
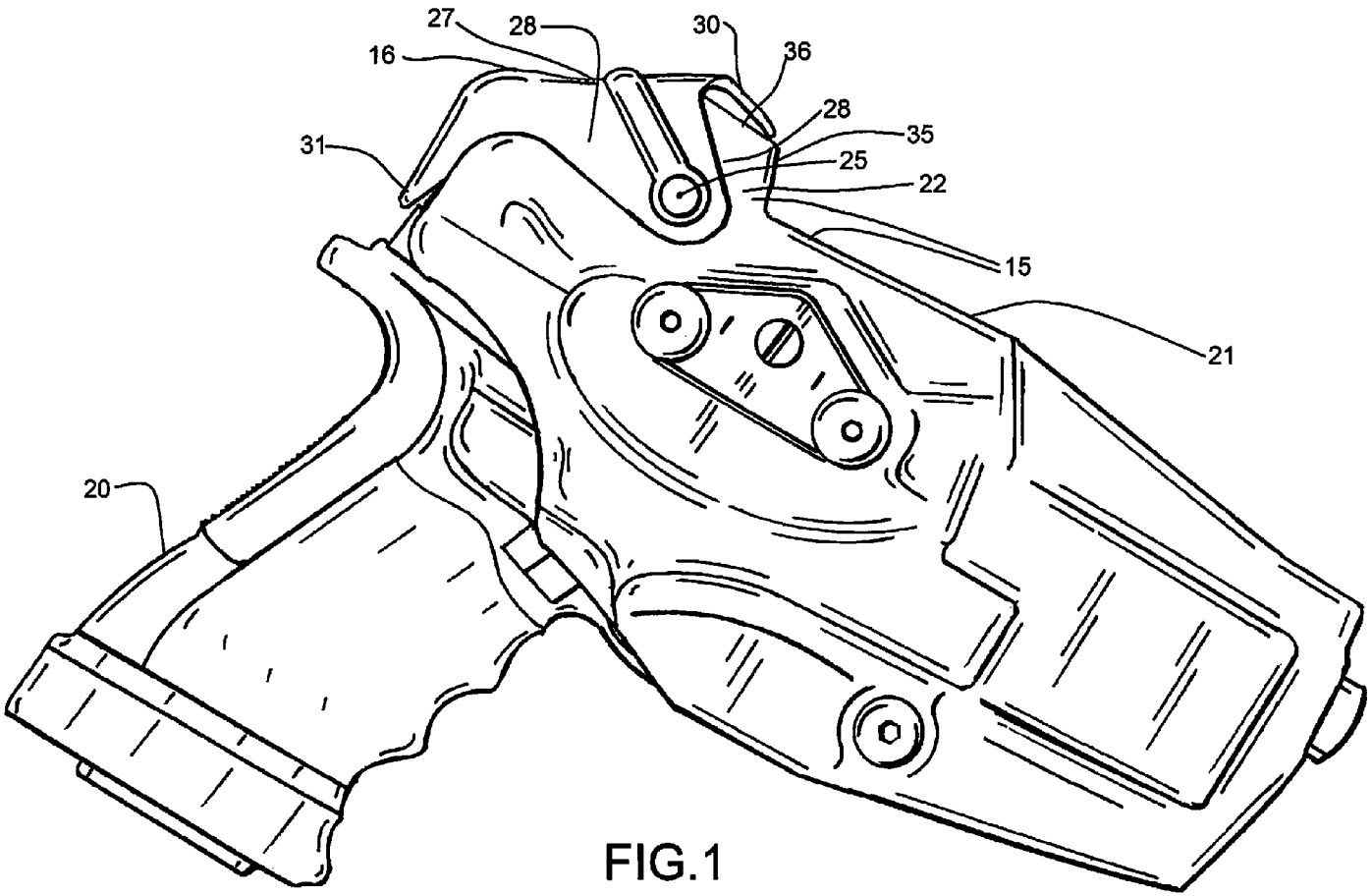
Figure 2:
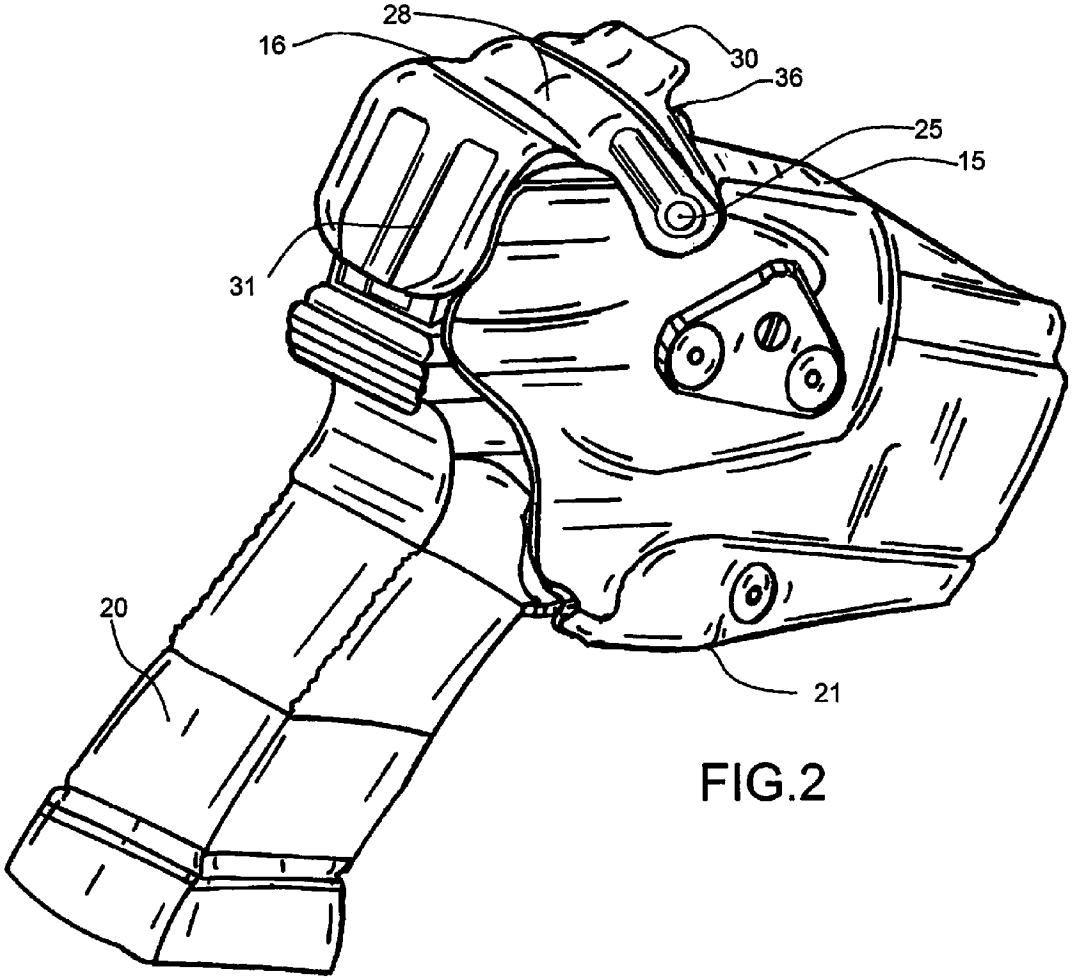
FIG. 2 is a rear perspective view of FIG. 1.
Figure 6:
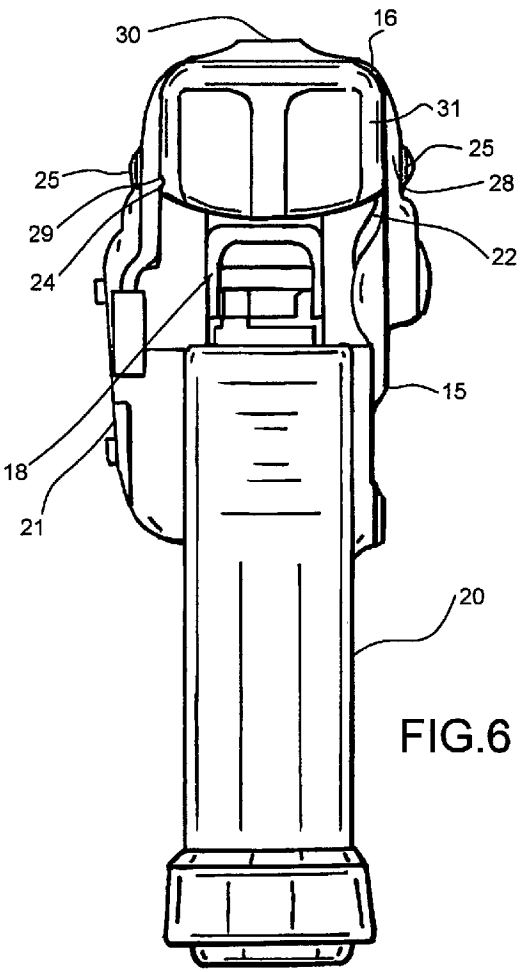
FIG. 6 is a rear elevational view of FIG. 4.
Figure 3:
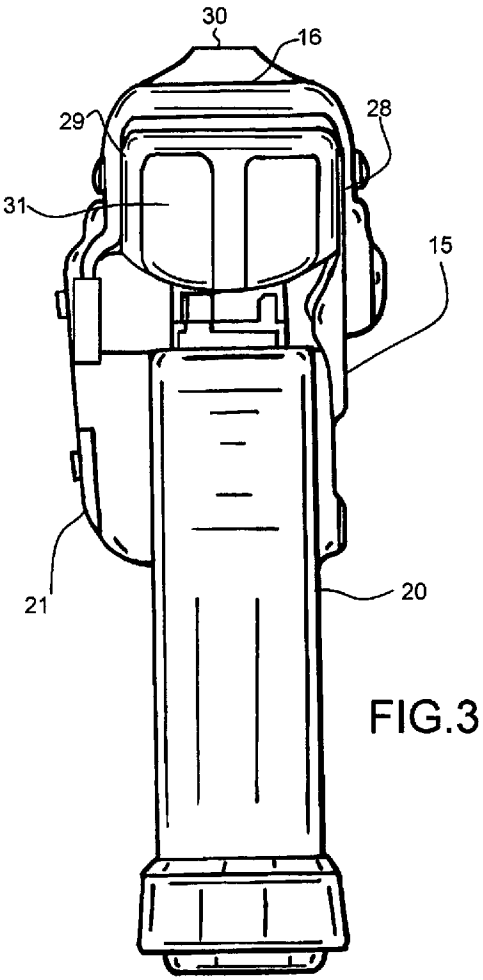
FIG. 3 is a rear elevational view of FIG. 1.
Figure 4:
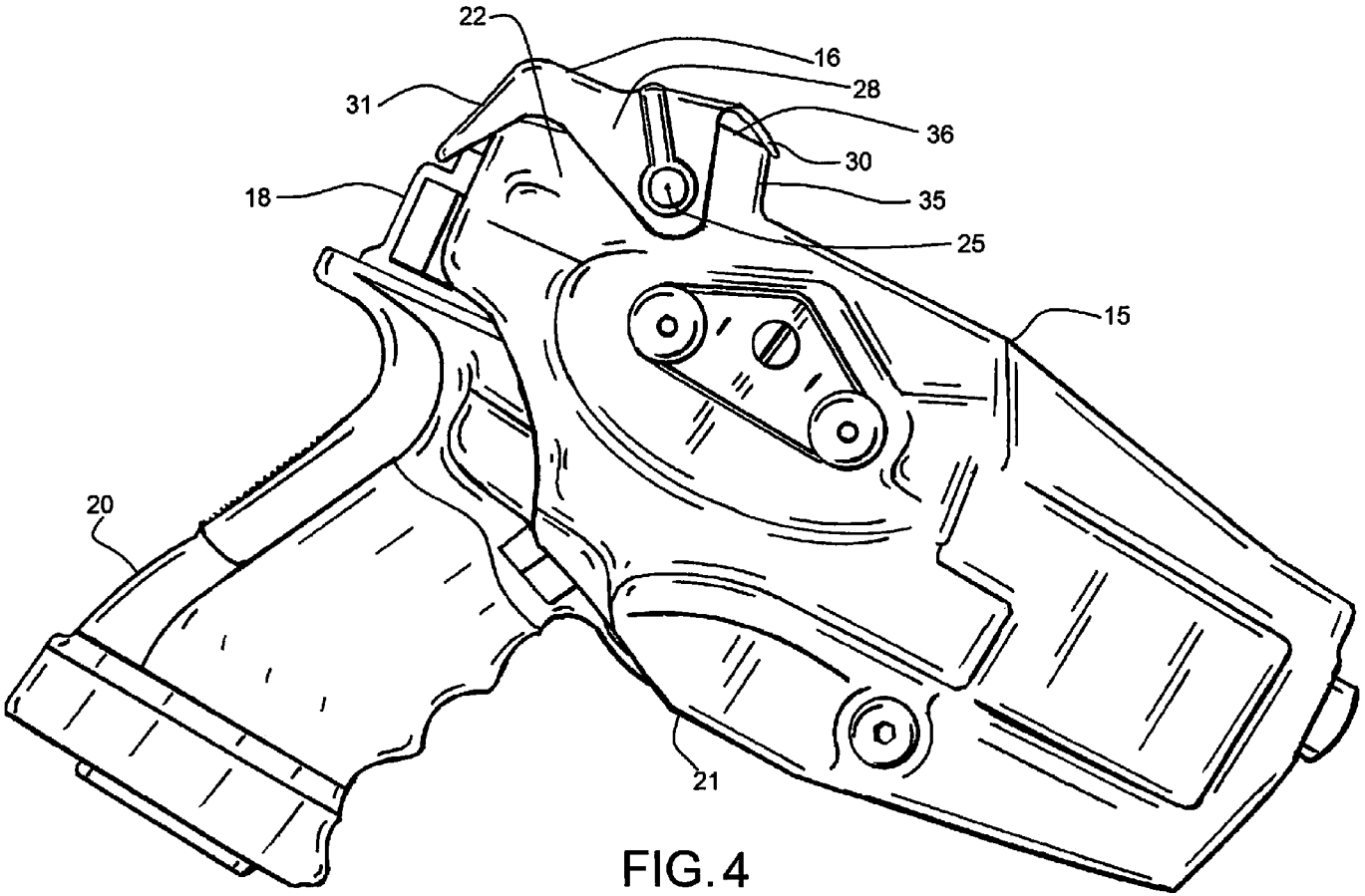
FIG. 4 is a side elevational view similar to FIG. 1, with the protector shown in a partially open position.
Figure 5:
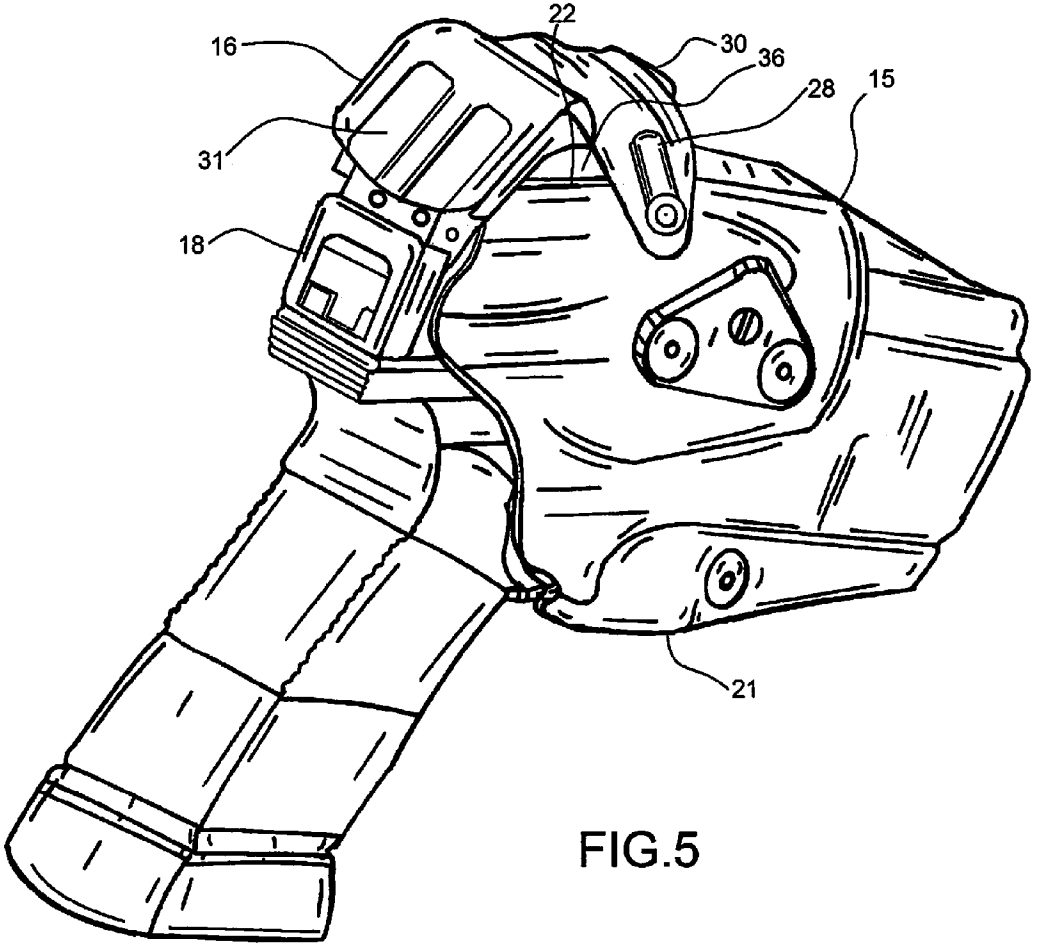
FIG. 5 is a rear perspective view of FIG. 4.
Figure 7:
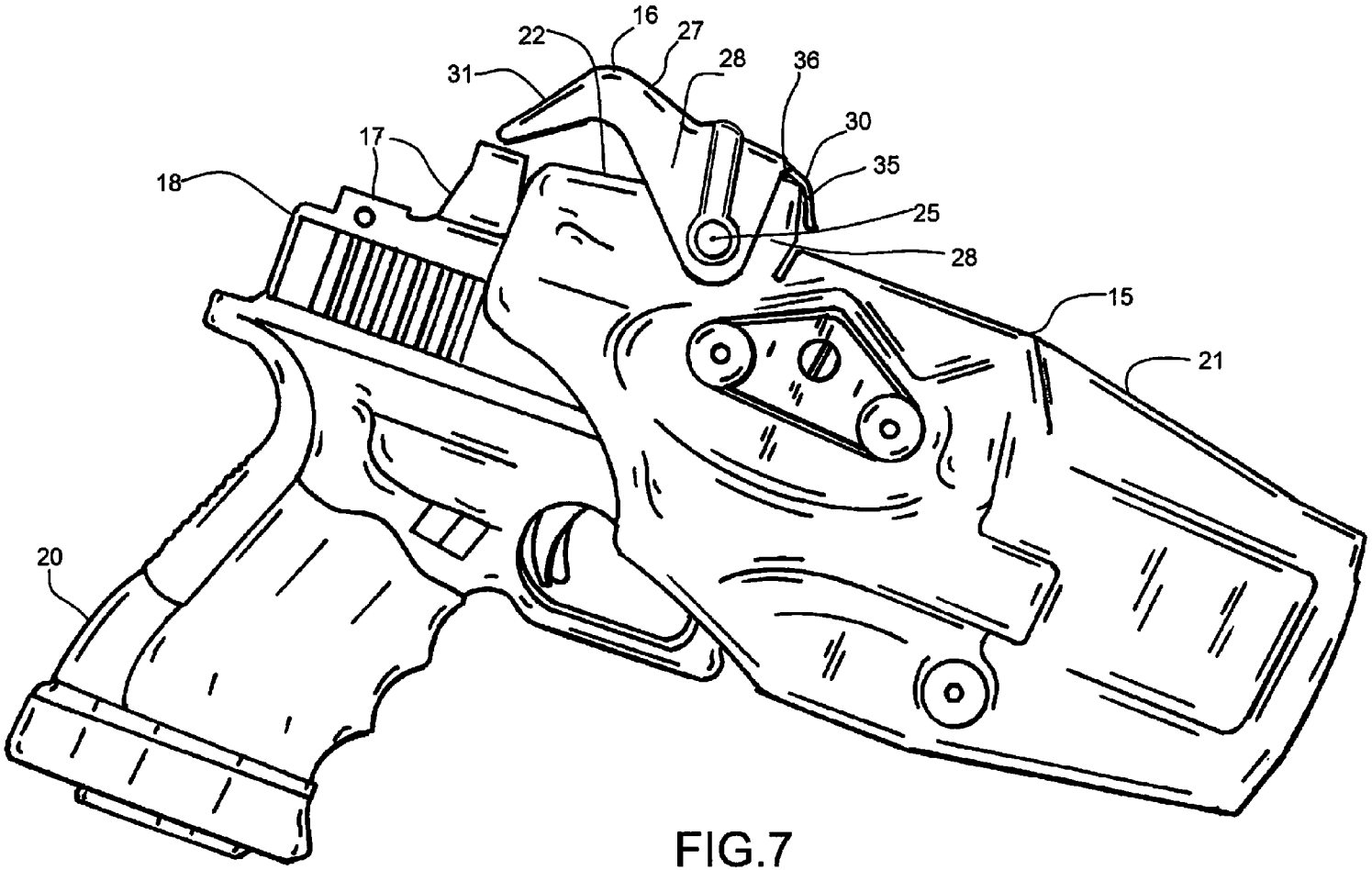
FIG. 7 is a side elevational view similar to FIGS. 1 and 4 showing the handgun being withdrawn from the holster and the sight clearing the protector in fully open position.
Figure 8:
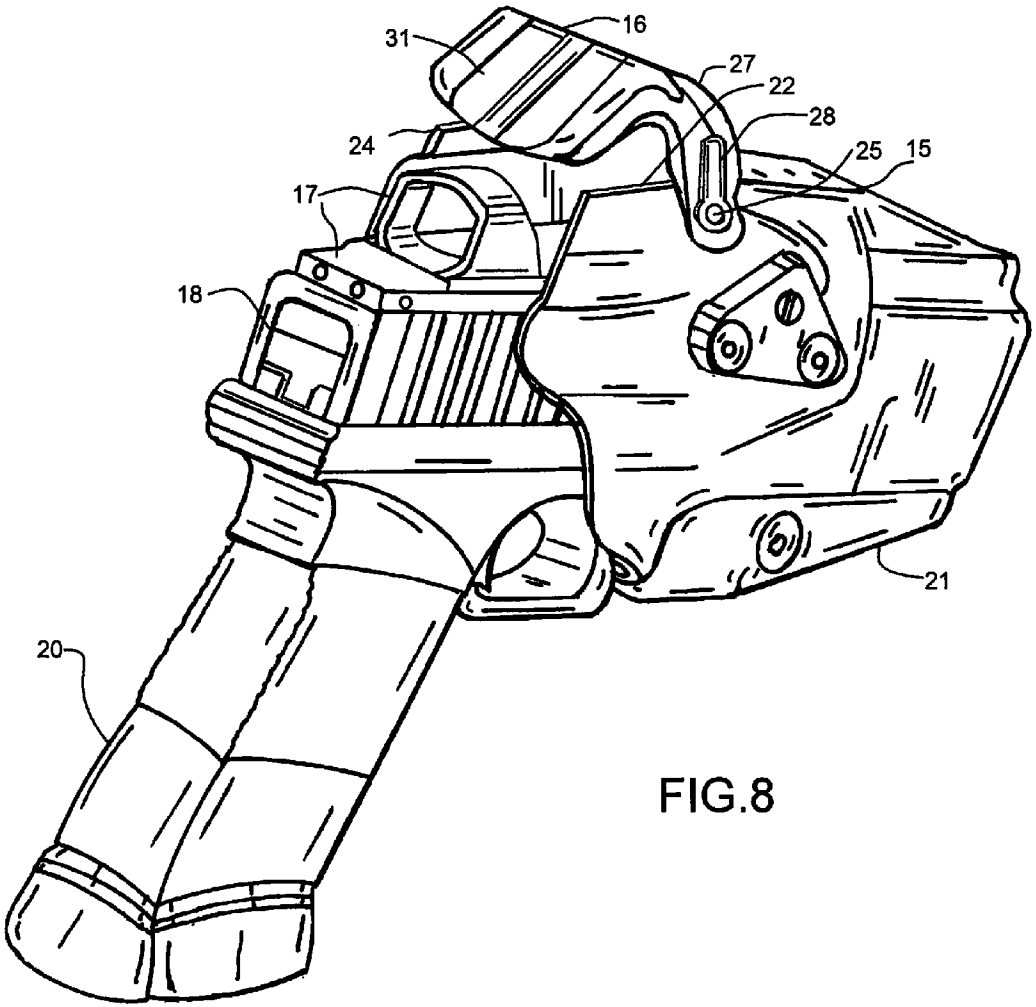
FIG. 8 is a rear perspective view of FIG. 7.
Figure 9:
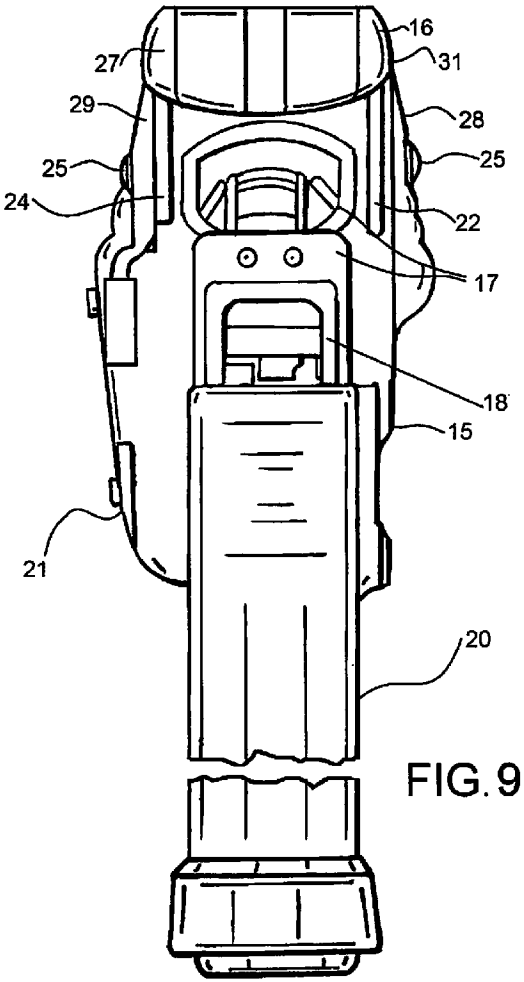
FIG. 9 is a rear elevational view of FIG. 7.
Figure 9A:
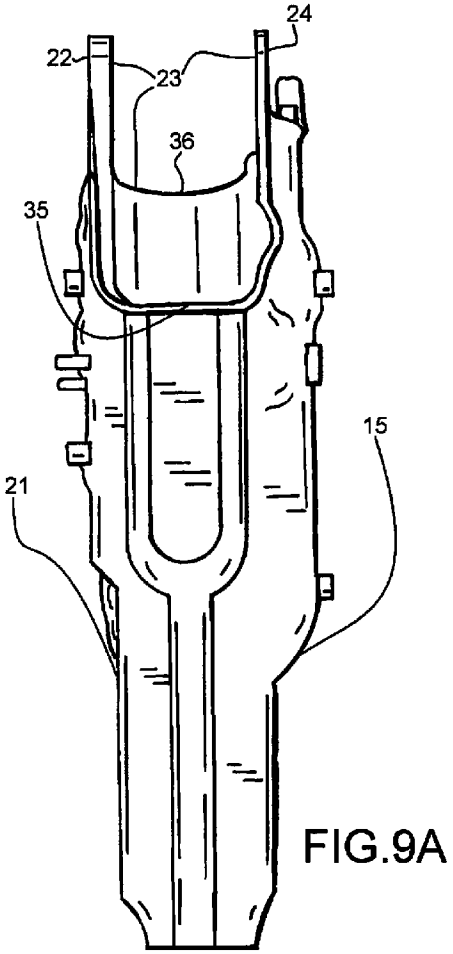
FIG. 9A is an elevational view of the forward portion of the holster of this invention without the protector for clarity of illustration of the pocket which partially covers the optical sight (not shown)
Figure 10:
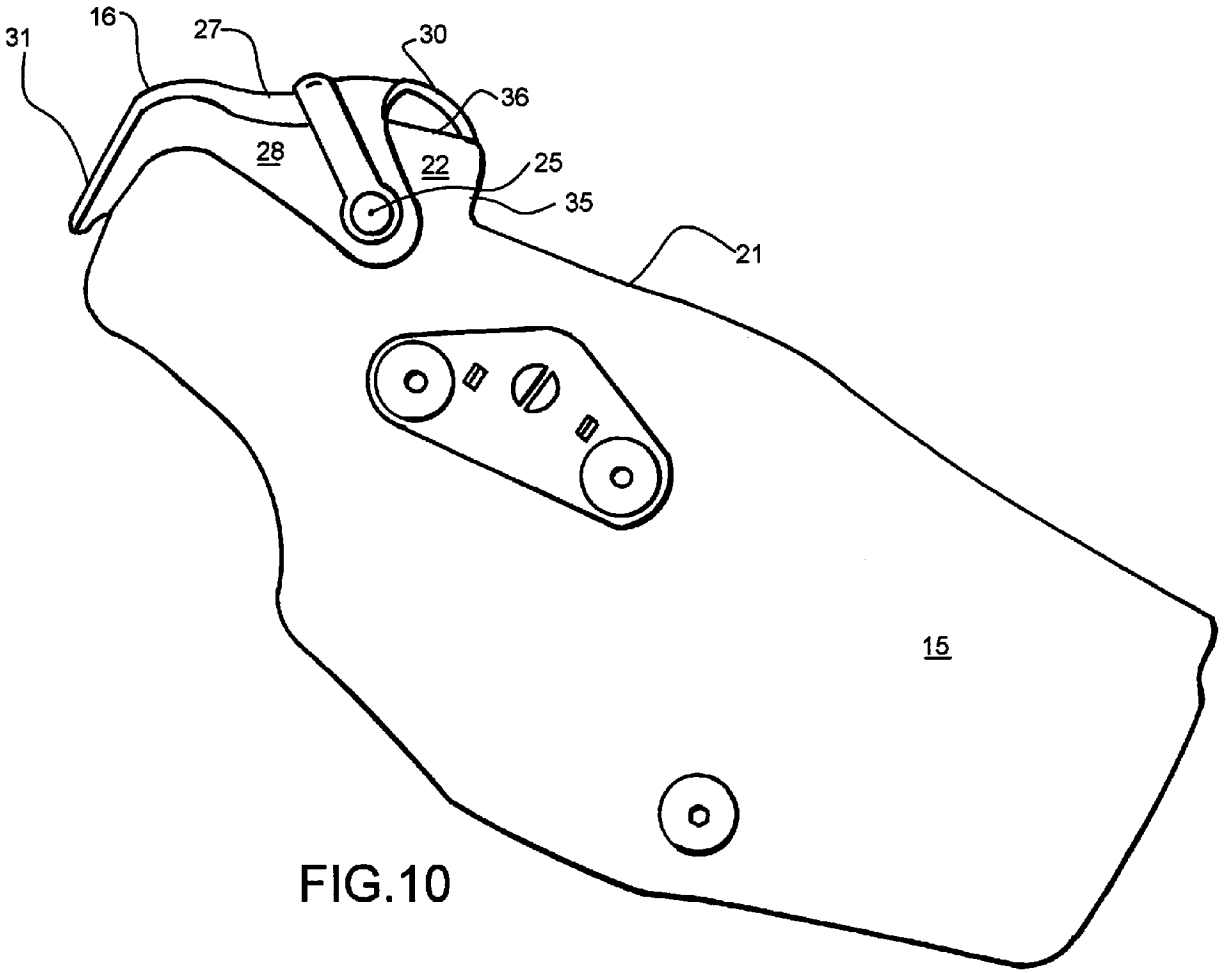
FIG. 10 is a view similar to FIG. 1 of the holster, without the handgun, and showing the protector in a fully closed position.
Figure 11:
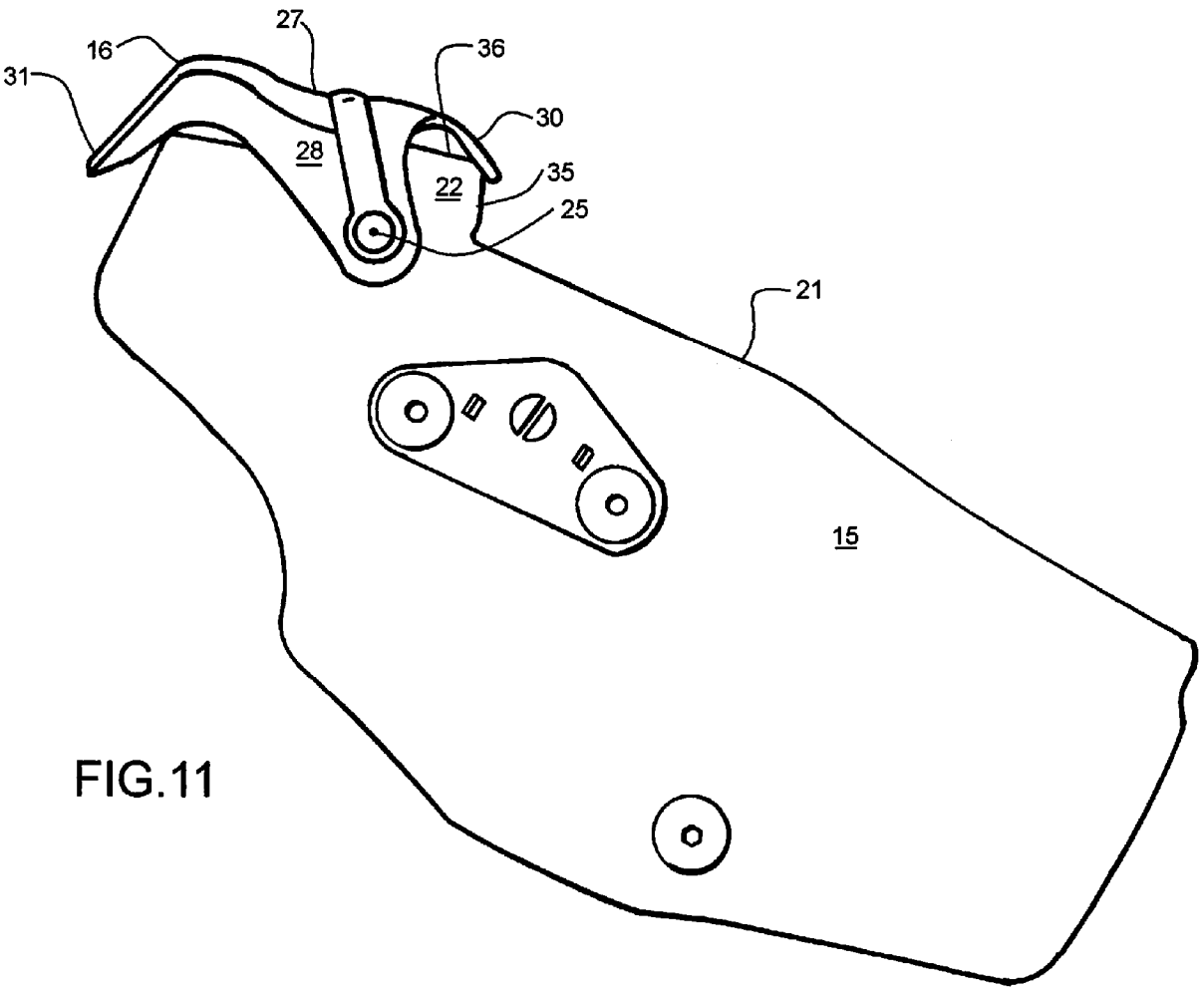
FIG. 11 is a view similar to FIG. 4 of the holster, without the handgun, and showing the protector in a partially open position.
Figure 12:
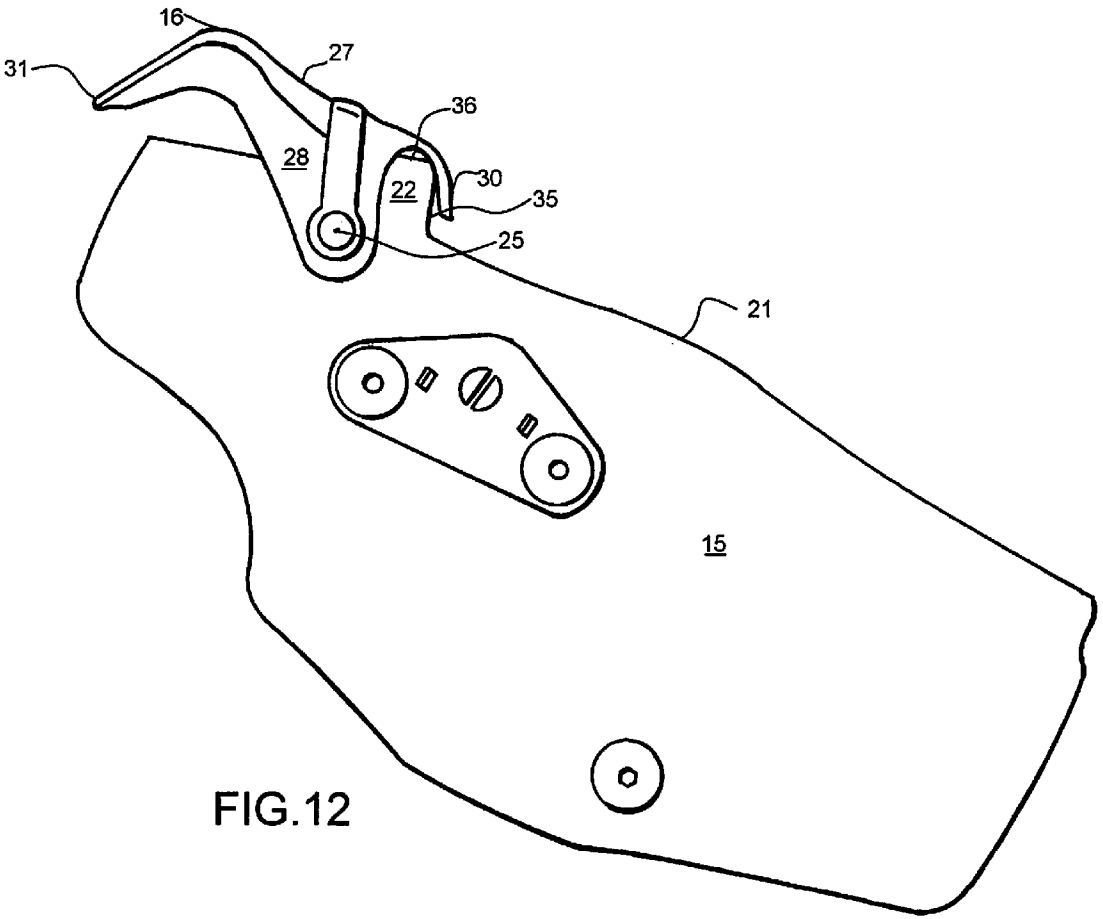
FIG. 12 is a view similar to FIG. 7 of the holster, without the handgun, and showing the protector in a fully open position.

Referring to FIGS. 1-3, according to present invention is seen to include a firearm holster 15 with an optical sight protector 16 in the form of a cover or shield that protects an optical sight 17 mounted on a rear slide 18 of a firearm 20, as shown most clearly in FIGS. 7-9.

Holster 15 includes a pair of sidewall extension portions 22 and 24 extending above slide 18, as shown most clearly in FIGS. 3-11, and respectively attached thereto by laterally aligned pivots 25, for movably connecting protector 16 to holster 15. In the embodiment shown, protector 16 includes a generally inverted U-shaped body 27 with spaced depending protector wall portions 28 and 29 which are closely adjacent to and partially overlap holster sidewall extension portions 22 and 24. Sidewall extension portions 22 and 24 are spaced and generally parallel and form a pocket 23 with a forward wall portion 35 between the sidewall extension portions 22, 24 and an arched upper wall portion 36. Body 27 includes a forward integral polymeric tensioned spring tab 30, which contacts forward and upper wall portions 35 and 36, and exerts a constant downward pressure on protector 16, thereby biasing protector 16 downwardly at rear end wall portion 31 to maintain protector 16 in a fully closed position with or without a firearm being placed in holster 15.

Pocket 23 preferably is integrally formed with holster body 21 and is configured to receive and cover at least a portion of optical sight 17, the rear face of the lens, when firearm 20 is fully holstered. Pocket 23 and protector 16 completely cover the optical sight 17 when protector 16 is in a fully closed position shown in FIGS. 1-3 and FIG. 10.

In an embodiment, when firearm 20 is holstered and protector 16 is in a closed position, body 27 and pocket 23 fully wrap around and enclose optical sight 17. Body 27 and pocket 23 preferably are configured to partially enclose slide 18.

Considering the FIGS. 1-3 and 10-12, holster 15 may be utilized in the following exemplary manner to cover and protect optical sight 17. As will be apparent to those skilled in the relevant art(s) after reading this description, alternate embodiments of holster 15 may be used in the same manner and in differing manners.

Starting with the fully open position of protector 16 (shown in FIGS. 7-9 and 12) and after firearm 20 is inserted into holster 15, a user may use his thumb to depress protector 16 into a partially closed position until protector 16 rotates over center about the pivot axis between aligned pivots 25. When that occurs, spring tab 30 assists in the movement of protector 16 into the fully closed position of FIGS. 1-3 and FIG. 10. Spring tab 30 thus biases protector 16 closed. Manual manipulation of protector 16 is required to open protector 16 when it is in the fully close position. Such manipulation may be done either by thumb engagement and movement or by withdrawal of firearm 20 from holster 15, as shown and illustrated by the progression of protector 16 from closed in FIGS. 1-3 and 10, then to partially open in FIGS. 4-6 and 11, and lastly to fully open in FIGS. 7-9 and 12.

In summary, protector 16 is a tight fitting cover or shield and may be an integral part of holster 15. Protector 16 may be located above the back of the handgun slide 18 which carries optical sight 17. Protector 16 functions as a closure or cap for the open top of holster 15 directly above the back of slide 18 and optical sight 17. In most embodiments, protector 16 preferably is not part of the securing device of the designed holster; therefore any failure would not disable the user's ability to draw handgun 20 from the holster. Protector 16 tightly fits the top of the holster 15, deflecting any debris that would fall on the back of slide 18 or lens of optical sight 17. Protector 16 rotates about the pivot axis formed by aligned pivots 25 and has two positions. Closed and secure position, as shown in FIGS. 1-3 and FIG. 10, when handgun 20 is holstered and open position and maintained open, as shown in FIGS. 7-9 and FIG. 12, when handgun 20 has been removed.

The operation of opening pivoting protector 16 when drawing handgun 20 preferably is automatic, moving handgun 20 toward the open top automatically opens the protector 16 to open position allowing handgun 20 to be drawn without interference with the drawing process, (only to overcome the weak biasing of spring tab 30 and friction during movement of protector 16 on holster 15). Pivoting protector 16 may remain in the open position until handgun 20 is re-holstered into holster 15. Protector 16 can be manually closed, if necessary, without the handgun in place. In an embodiment, protector 16 may be designed so that the operation of re-holstering the handgun 20 will cause protector 20 to be automatically repositioned closed.

The pivoting protector 16 is preferably formed from the typical holster body materials or can be injection molded using a variety of high grade polymers.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described.

In addition, it should be understood that the figures in the attachments, which highlight the structure, methodology, functionality and advantages of the present disclosure, are presented for example purposes only. The present disclosure is sufficiently flexible and configurable, such that it may be implemented in ways other than that shown in the accompanying figures.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present invention in any way.

What is being claimed:

1. Apparatus comprising:

a holster configured to support handgun on a user;

a handgun that manually movable into and out of the holster;

an optical sight mounted on the handgun, the optical sight including a lens; and a protector mounted on the holster for pivoting movement between an open position and a closed position;

the protector when in the open position allowing movement of the handgun, with the optical sight attached, into and out of the holster;

the protector when in the closed position, when the handgun is in the holster, covering and protecting the lens of the optical sight;

the protector automatically moving from the closed position to the open position in response to withdrawal of the handgun from the holster, initially by engagement of a rear portion of the firearm with a rear wall portion of the protector and thereafter by engagement of the optical sight with the rear wall portion of the protector, as the firearm and the optical sight are slidably drawn out from the holster;

the protector, alternatively, being manually movable from the closed position to the open position by manual engagement and pivoting movement of the protector; and the protector having a mechanism that holds the protector in either the closed position of the open position;

the mechanism including a tab that is formed as part of the pivoting protector, the tab moving over a projecting portion of the holster between a first surface and a second surface of the holster, during movement of the protector between the open and closed positons; and the tab engaging the top side surface of the holster when the open position thereby holding the protector in the open position, the tab engaging the forward side surface of the holster when the protector is in the open position thereby holding the protector in the closed position.

2. Apparatus as set forth in claim 1 wherein the tab resiliently deforms when it moves over the projecting portion of the holster during movement of the protector between the open and closed positions, and the tab resiliently engages the top side surface of the holster when the protector is open position, and the tab resiliently engage the forward side of the holster when the protector is in the open position.

3. Apparatus as set forth in claim 2 wherein the first surface of the holster is a top side surface of the holster and the second surface of the holster is a forward side surface of the holster, and wherein he projecting portion of the holster is an edge portion located between top side surface and the forward side surface.

4. Apparatus as set forth in claim 1 wherein the protector is formed as a U-shaped body having an upper wall and a pair of spaced depending side walls and a rear wall, which together with the tab define a pocket formed to slidabilty accept the optical sight when the protector is in the open position, the rear wall of the U-shaped body covering the lens of the optical sight when the protector is in the closed position.

5. Apparatus as set forth in claim 4 further including aligned pivots respectively connecting the side walls of the protector to side wall extension portions of the holster, the side walls of the protector being located outwardly of the sidewall extention portions of the holster, the protector being pivotable about the aligned pivots between the closed position and the open position.

6. Apparatus as set forth in claim 1 wherein the rear portion of the firearm is a firearm slide.

* * * * *